US006741444B2

(12) United States Patent
Jacobs et al.

(10) Patent No.: US 6,741,444 B2
(45) Date of Patent: May 25, 2004

(54) APPARATUS FOR CHARGING A SUBSTRATE AND AN IMAGE FORMING APPARATUS COMPRISING AN APPARATUS OF THIS KIND

(75) Inventors: Gerardus Matheas Hubertus Maria Jacobs, Venlo (NL); Albin Bernhard Werner Haas, Roermond (NL); Gerardus Johannes Marie Hendericks, Venlo (NL)

(73) Assignee: Océ-Technologies B.V., Venlo (NL)

( * ) Notice: Subject to any disclaimer, the term of this patent is extended or adjusted under 35 U.S.C. 154(b) by 0 days.

(21) Appl. No.: 10/191,457

(22) Filed: Jul. 10, 2002

(65) Prior Publication Data

US 2003/0016483 A1 Jan. 23, 2003

(30) Foreign Application Priority Data

Jul. 23, 2001 (NL) ..... 1018613

(51) Int. Cl.[7] ..... H05F 3/00

(52) U.S. Cl. ..... 361/220; 361/212; 361/225; 361/229; 361/234; 361/235

(58) Field of Search ..... 361/220, 212, 361/213, 225, 229, 230, 234, 235, 233, 56, 91, 111, 232, 214, 222; 445/52, 58; 430/24, 25, 26

(56) References Cited

U.S. PATENT DOCUMENTS 3,655,966 A 4/1972 Takimoto et al.
4,178,568 A * 12/1979 Gunton
4,639,577 A 1/1987 Sturdevant
5,083,959 A 1/1992 Datta et al.
5,228,966 A * 7/1993 Murata
5,453,660 A * 9/1995 Martin et al.
5,990,619 A * 11/1999 Ilcisin et al.
6,208,499 B1 3/2001 Yonekawa et al.
6,458,500 B1 * 10/2002 Zhao et al.

OTHER PUBLICATIONS

Patent Abstracts of Japan, vol. 017, No. 293 (P–1550), Jun. 4, 1993.

Patent Abstracts of Japan, vol. 1997, No. 09, Sep. 30, 1997.

* cited by examiner

*Primary Examiner*—Dean A. Reichard
*Assistant Examiner*—Nguyen T. Ha
(74) *Attorney, Agent, or Firm*—Birch, Stewart, Kolasch & Birch

(57) ABSTRACT

An apparatus for charging a substrate including a dielectric substrate, a support member having a first end and a second end between which the member extends substantially parallel to the substrate, a row of electrodes distributed over the support member between the first and second ends, the electrodes extending from the support member in the direction of the substrate, the electrodes having a free end for spraying a charge on the substrate, each free end having a substantially fixed distance from the substrate, wherein the distance in the case of the electrode located at the first and second end of the support member differs substantially from the distance in the case of the electrode located in the middle of the support member.

6 Claims, 3 Drawing Sheets

APPARATUS FOR CHARGING A SUBSTRATE AND AN IMAGE FORMING APPARATUS COMPRISING AN APPARATUS OF THIS KIND

BACKGROUND OF THE INVENTION

The present invention relates to an apparatus for charging a substrate comprising a dielectric substrate, a support member having a first end and a second end between which said member extends substantially parallel to the substrate, a row of electrodes distributed over the support member between the first and second ends, said electrodes extending from the support member in the direction of the substrate, the electrodes having a free end for spraying a charge on the substrate, each free end having a predetermined, mainly fixed distance from the substrate. The present invention also relates to an image forming apparatus provided with an apparatus of this kind.

An apparatus of this kind is known from Japanese Laid-Open specification JP 03164467, in which a corona unit is described which can be used in an image forming apparatus, for example a printer, copying machine or fax. Apparatus of this kind frequently makes use of an image forming process wherein a dielectric substrate, usually a photoconductor, is uniformly charged in a first step by use of a corona unit. For this purpose, a pin corona is used in JP 03164467. In a corona of this kind, a large number of individual electrodes extend from the support member in the direction of the substrate which is to be charged. In this case the support member is an elongated electrically conductive member of a length substantially equal to the width of the substrate for charging. In this way the substrate can be charged over its full width by passing it beneath the corona unit. At their free ends the electrodes are provided with a sharp point with a very small radius. By the application of a high voltage between the electrodes and the substrate, a charge will be sprayed from the point of the electrode in the direction of the substrate. Since the substrate is dielectric, charge can thus be built up on the surface of the substrate. In a following step, a charge image is then created on the substrate by discharging the substrate imagewise. This charge image can then be converted to a visible image by developing it with toner. To obtain good image quality, it is important that a uniform charge is applied to the surface of the substrate during the initial charging. Frequently, a non-uniform charge of the substrate is obtained due to all kinds of effect. For example, at the ends of the support member there are edge effects which are perceptible. Since the outermost electrodes have no more neighboring electrodes, there will often be less charge sprayed on to the substrate in the vicinity of these ends per unit area. JP 03164467 does not give any solution for this problem. By bending the support member of the corona unit in the vicinity of the respective ends in a plane parallel to the substrate, the effective electrode density is greater at these ends. In this way the lower charge in the vicinity of the ends can be compensated.

However, the apparatus known from JP 03164467 has one significant disadvantage. Since the support member has a bend, it is practically impossible to clamp this element in a corona unit while retaining the required bend. Clamping of this kind is necessary in order to obtain a reliable location of the support member in the corona charging apparatus. In the absence of a reliable location of this kind, the charging level of the substrate cannot be obtained at a predetermined and uniform value, which has an adverse effect on the final image quality.

SUMMARY OF THE INVENTION

The object of the present invention is to obtain an apparatus for charging a substrate whereby a predetermined uniform or substantially uniform charging of the substrate can be obtained. Toward this end, an apparatus has been developed, wherein the said distance in the case of a first electrode differs substantially from said distance in the case of a second electrode.

It has been found that charging the substrate at the location of an individual electrode can be influenced by varying the distance between the free end of the electrode and the substrate. As soon as a change of this distance results in a perceptible change in the charging level of the substrate (approximately one volt is already perceptible), this may be referred to as a substantial change. A smaller distance often results in a stronger charging of the substrate, while a larger distance results in a weaker charge. If the charge is locally too weak, for example at the edge of the substrate, the charge can be brought to an adequate level by precisely reducing, at that location, the distance between the free end of one or more electrodes and the substrate. A change in the distance equal, for example, to one-tenth of a millimeter will result in a perceptible change of the charging level of the substrate at the corresponding electrode. If the charge is locally too strong for any reason whatsoever, then the distance of the free end of one or more electrodes corresponding to that location could be increased. It is thus possible in an effective manner to obtain a corona unit which has no bend but nevertheless results in an adequately uniform charging of the substrate. Since the support member can be made completely straight, it can be fixed in a known manner in the corona unit so that a reliable location with respect to the substrate can be obtained. Therefore, by using an apparatus according to the present invention, a predetermined uniform or almost uniform charging of the substrate can be obtained.

Charging apparatus in which pin coronas are used is also known from U.S. Pat. Nos. 3,655,966 and 5,083,959, in which the free ends of the electrodes do not extend through a straight line. Nevertheless, it is known from both patent specifications that each of the free ends must have the same distance from the substrate for charging, in order to obtain a uniform charge. The configuration of the free ends is used as an adaptation to a bend of the associated substrates. As a result, these known devices still have the problem of a non-uniform charge. This means that these devices are further away from the present invention than the above-described apparatus.

In one embodiment of the present invention, said distance for electrodes in the vicinity of the first and second ends of the support member is less than the distance for electrodes in the vicinity of the middle of the support member. It has been found that a weaker charge occurs particularly at the edges of the substrate, in many corona units. The apparatus according to this embodiment solves this problem by placing the free ends of one or more electrodes in the vicinity of these edges more densely in the neighborhood of the substrate, so that the charging level is locally influenced positively. By selecting a suitable distance, it is possible in principle completely to compensate for the difference in charging level so that a uniform charge is obtained.

In another embodiment of the invention, the electrodes in the row are substantially congruent and the support member has a side for carrying the electrodes, said side being profiled. In this embodiment, the electrodes themselves are substantially identical and of the same shape. This has the advantage that the spraying behavior of the electrodes is also substantially equal, and this has a favorable influence on image quality. A difference in the distance of the free end of an electrode from the substrate is obtained in this embodiment by locally displacing the support member, at least that side of said member which carries the electrodes. As a result, this side acquires a profile. A profile of this kind can assume many shapes. If only one end of an electrode is to be displaced, said profile can, for example, be a step function. In a practical embodiment, however, it will more frequently be the case that a number of adjoining free ends must be displaced. This can be done, for example, by giving the associated side of the support member a gradually extending profile.

In another embodiment, said side of the support member is so profiled that said side forms part of a polygon, each side of the polygon carrying at least one electrode. In this embodiment, the profile extends gradually, via a number of straight support elements merging into one another and which in each case form a different angle with the substrate. It has been found that a support member according to this further embodiment is simple to produce because the electrodes themselves can remain in the same form.

In a further embodiment, the sides of the polygon which form an angle with the substrate other than mainly 180° carry a maximum of five electrodes. It has been found that with an apparatus according to this embodiment a predetermined uniform of the substrate can be obtained in simple manner. Since the number of electrodes for each support element is restricted to a maximum of five, the charging level can be accurately controlled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
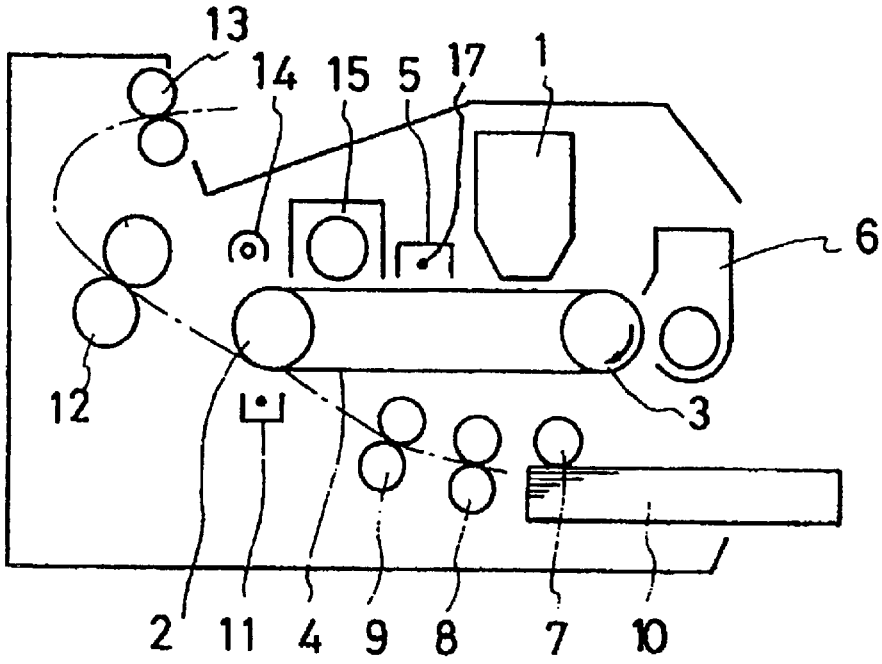
FIG. 1 is a diagram of an image forming apparatus.

FIG. 1 diagrammatically illustrates an image forming apparatus, a digital printer in this embodiment. The printer comprises a printhead 1, which comprises a page-wide LED-array (not shown). The printhead is actuated via a controller (not shown), which converts digital data into pixel information. The printer is provided with an endless photosensitive belt 4 trained around the rollers 2 and 3. At least one of these rollers is driven by a motor (not shown), so that the belt rotates in the indicated direction at a substantially constant speed. During the rotation, the outer surface of the belt 4 is uniformly charged by means of a corona unit 5, which is disposed upstream with respect to the printhead 1. In this embodiment the corona unit comprises a support member 17 extending over the width of the belt 4. The support member is provided with a large number of electrodes 18 (also shown in FIGS. 2, 3 and 4) which are distributed uniformly over the length of the support member. In this way a pin array is formed. The corona unit is practically as long as the belt 4 is wide in order to prevent excessive charge from being sprayed next to the belt 4. This causes charges in the apparatus, which have a negative influence on the operation of the apparatus and may even be dangerous to a user of the apparatus. The LED's of the printhead are adapted to be individually actuated by means of a driver circuit (not shown) operatively connected to the LED's. In this embodiment, the driver chips are also located on the above-mentioned substrate. The driver circuit is actuated image-wise by means of external pulses so that the LED's illuminate the charged photoconductor 4 image-wise. As a result, the charge on the surface of the photoconductor 4 is selectively dissipated so that an electrostatic latent charge image forms on the photoconductor while it is passing the printhead. This charge image is taken to a developing station 6 where the charge image is converted to a visible image, for example by developing the charge image with toner as is well-known from the prior art.

The toner image is then conveyed to a transfer station where, in this embodiment, a transfer corona 11 is situated. On the other side, a receiving material 10, for example a sheet of paper, is detached from a stock pile by the use of separating roller 7. The receiving material is then conveyed by transport rollers 8 and 9, which also act as registration rollers, to the transfer station. By correct timing, the toner image and receiving material come into registration at the transfer station. In this station, the toner image is transferred from the photoconductor 4 to the receiving material 10 by means of the transfer corona 11. The receiving material 10, which now carries the toner image, is then fed through a fixing station 12, where the toner image obtains permanent adhesion to the receiving material by the use of heat and pressure. The receiving material 10 is then placed in the printer delivery tray by means of the roller pair 13.

The printer also contains a post-exposure lamp 14 in order to illuminate any residual charge present on the photoconductor. The belt 4 is then cleaned in cleaning station 15, where any residual toner is removed from the surface of the belt 4. The printing process can then re-start for this part of the belt.

With respect to the present invention it is immaterial how the corona unit 5 is actually constructed. For example, it is possible to use more than one support member. It is also possible to create around the pin array a special ventilation system, which if required may be equipped with one or more filters, so that soiling of the array, the belt 4 and other parts of the apparatus is minimized. The specific location of the corona unit with respect to the belt also forms no part of the present invention. It is possible, for example, to adapt the corona unit so that it can be placed level with a curvature in the belt, for example where it is trained around a roller.

Figure 2:
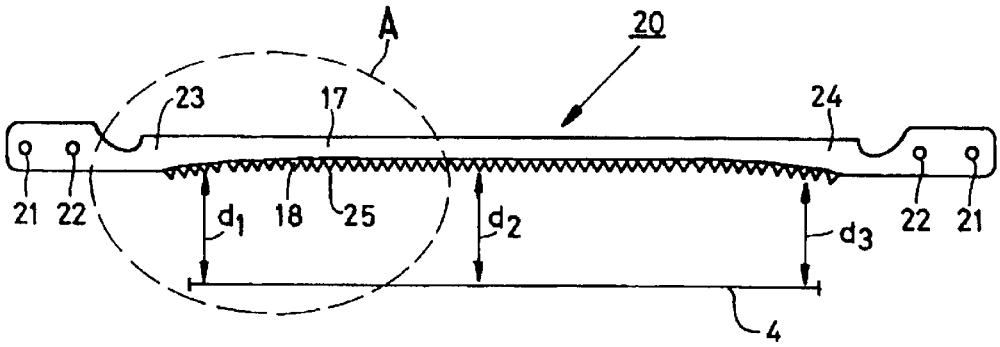
FIG. 2 is a diagram of a support member provided with electrodes.

FIG. 2 diagrammatically illustrates a support member 17 provided with electrodes 18. Together they form important components of the pin array 20. In this embodiment, the pin array consists of an elongate and flat support member made from a conductive metal. At its first and second ends the support member is provided with holes 21 and 22 so that the support member can be fixed in a corona unit.

When the pin array is incorporated in an apparatus for charging a substrate 4, the array extends substantially parallel to the substrate. For simplification, the other parts of the corona unit have not been shown. The row of electrodes 18 extends from the surroundings of the first end 23 to the surroundings of the second end 24 of the support member. In this case the electrodes arc distributed equally over a certain length of the support member, which length is somewhat greater than the width of the substrate 4. In order to charge the substrate uniformly, the distances d1 and d3 of the free ends 25 of the electrodes 18 from the substrate 4 in the neighborhood of the locations 23 and 24 are smaller than the distance d2 of the free ends of the electrodes from the substrate in the middle of the support member. In this embodiment, in which there is a voltage of about 8 kV between the substrate and the support member, the distance d2 is typically 30 mm. As a result of the potential difference between the array 20 and the substrate, an electric field is present between this array and the substrate. Due to the considerable curvature of the electrodes at their end 25, the field strength at this curvature is very strong and the air surrounding these ends is ionized. In this case, since the substrate 4 has a positive potential with respect to the support member 17, the negatively charged particles will move in the direction of the substrate 4. As a result the surface of said substrate will be charged negatively. In this embodiment the substrate 4, which is an organic photoconductor, is typically charged to a potential of 150 volts. If no further steps are taken, the inequality of this potential over the width of the photoconductor would often be more than 10 volts. The reasons for this are the edge effects as described above, and also mechanical tolerances in the image forming apparatus, lack of homogeneity in the photoconductor and other phenomena. In principle, each non-uniformity in the charge over the width of the substrate 4 (corresponding to the length of the corona unit) can be corrected by the use of the present invention.

To correct the non-uniformity due to the edge effects at the corona unit, the distances d1 and d3 in this embodiment are 0.6 mm smaller than d2. As a result of this apparently minor change in the distance, the absence of electrodes at the ends 23 and 24 appears to be capable of almost complete compensation. In this way, an almost uniform charge of the substrate, typically with inequalities of less than 10 volts, and preferably less than 5 volts, can nevertheless be obtained.

Figure 3:
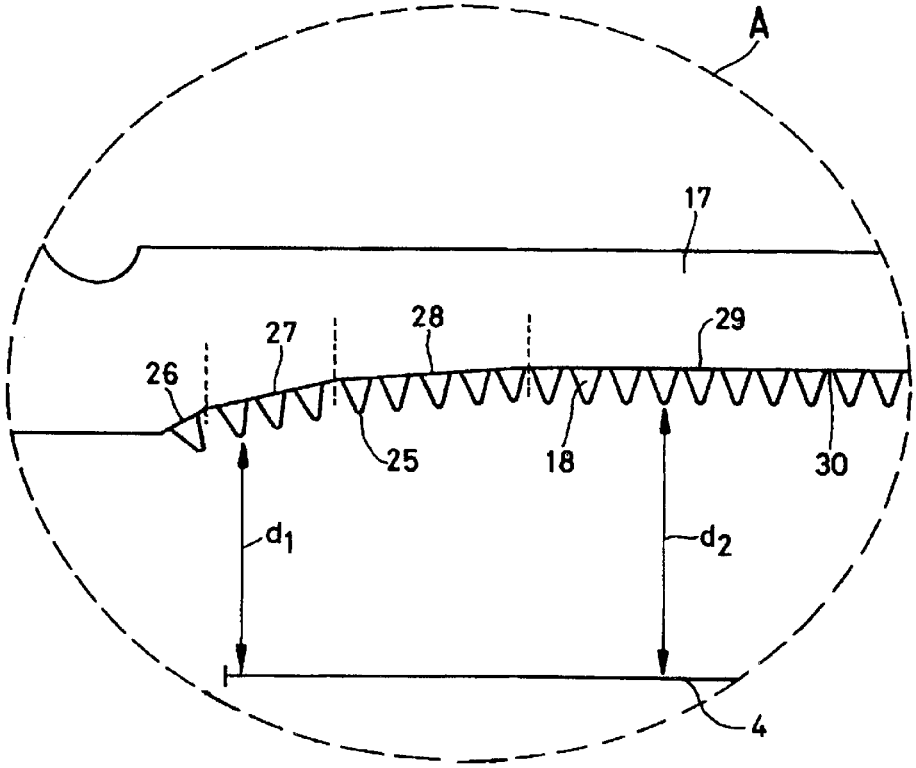
FIG. 3 shows part of the support member in greater detail.

FIG. 3 shows the part of the support member 17 indicated in FIG. 2 in greater detail by means of the ellipse A. This Figure shows that the side 30 of support member 17 which carries the electrodes 18 in this embodiment forms part of a polygon. For this purpose, side 30 is divided into a number of surfaces 26, 27, 28 and 29, each forming one side of the polygon. As a result, the support member is concave with respect to the substrate. The first side, surface 26 in this case, forms a relatively acute angle with the substrate 4. This side carries one electrode. The next side 27 carries three electrodes, which have an ever-increasing distance from the substrate. The next side 28 carries five electrodes, and these also have a distance which continuously increases with respect to the substrate. Finally, the fourth side 29 forms an angle of 180° with the substrate so that the free ends 25 of the electrodes on this side each have the same distance from the substrate, i.e. d2.

The present invention also includes other embodiments. The embodiment namely which is required to obtain a uniform charge of the substrate is dependent on many factors. For example, the magnitude of the inequality in the charge which requires compensation, the location of the inequality, the sign of the inequality (charge too high or too low), the required uniformity, the distance from the substrate, the mechanical tolerances in the apparatus containing the charging device, the number of electrodes, the type of electrode, the voltage between the pin array and the substrate, the type of substrate, the production technique for the pin array and so on, are all important in order to determine the most optimum embodiment.

Figure 4:
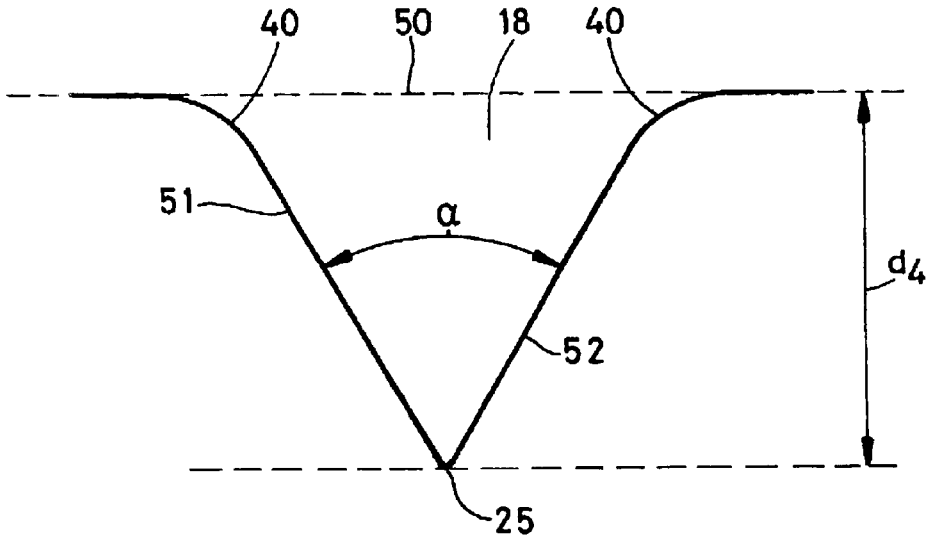
FIG. 4 is an example of an electrode.

FIG. 4 is an example of an electrode of the kind that can be used in the apparatus according to the present invention. In this embodiment the electrode 18 is formed into a triangular structure. The base 50 of the triangle coincides with side 30 as shown in FIG. 3. The triangle also comprises two sides 51 and 52 terminating at the free end 25. The total height of the triangle indicated by d4 is about 1.5 mm.

The charging behavior of an electrode of this kind depends greatly on the geometry of the electrode. Particularly the radius of the free end 25 is important, although the radius of curvature 40 and the size of the apex angle a also have an influence on the charging behavior. In this embodiment, the radius of the free end is about 0.02 mm and the radius of the curvature 40 is about 0.5 mm. The apex angle a is about 60°. As a result of the considerable curvature of the free end, the field strength around this end is very great when there is a voltage between the support member 17 and the substrate 4. As a result, the molecules in the air around this end are readily ionized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for charging a substrate comprising:

a dielectric substrate, a support member having a first end and a second end between which said support member extends substantially parallel to said substrate, a row of electrodes distributed over the support member between the first and second ends, said electrodes extending from the support member in the direction of the dielectric substrate and having a free end for spraying charge on the substrate, each free end having a predetermined fixed distance from the substrate, wherein said distance in a case of the electrodes located at the first and second ends of the support member, differs substantially from the distance in a case of the electrode located in the middle of the support member.

2. The apparatus according to claim 1, wherein the distance of the electrodes from the substrate in the vicinity of the first and second ends of the support member is less than the distance of the electrodes from the substrate in the vicinity of the middle of the support member.

3. The apparatus of claim 1, wherein the electrodes in the row are substantially congruent and where the support member has a side for carrying electrodes, said side is profiled.

4. The apparatus according to claim 3, wherein the support member is so profiled that the side forms part of a polygon, each side of the polygon carrying at least one electrode.

5. The apparatus according to claim 4, wherein the sides of the polygon winch form an angle with the substrate other than substantially 180°, carry a maximum of five electrodes.

6. An image forming apparatus containing an apparatus for charging a substrate as defined in claim 1.

* * * * *